US008674254B2

(12) United States Patent
Borgstrom

(10) Patent No.: US 8,674,254 B2
(45) Date of Patent: Mar. 18, 2014

(54) FLEXIBLE SEAL FOR HIGH VOLTAGE SWITCH

(75) Inventor: Alan D. Borgstrom, Hackettstown, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 273 days.

(21) Appl. No.: 13/305,080

(22) Filed: Nov. 28, 2011

(65) Prior Publication Data

US 2012/0193325 A1 Aug. 2, 2012

Related U.S. Application Data

(60) Provisional application No. 61/437,838, filed on Jan. 31, 2011.

(51) Int. Cl.
*H01H 33/66* (2006.01)

(52) U.S. Cl.
USPC ..... 218/136; 218/155

(58) Field of Classification Search
USPC ..... 218/136–140, 155–158
See application file for complete search history.

(56) References Cited

U.S. PATENT DOCUMENTS

| | | | | |
|---|---|---|---|---|
| 2,794,101 | A | | 5/1957 | Jennings |
| 3,812,314 | A | | 5/1974 | Nonken |
| 3,848,081 | A | | 11/1974 | Olsen et al. |
| 3,996,437 | A | | 12/1976 | Selzer |
| 4,124,790 | A | | 11/1978 | Kumbera et al. |
| 4,150,270 | A | | 4/1979 | Zunick |
| 4,492,837 | A | | 1/1985 | Crouch et al. |
| 4,568,804 | A | * | 2/1986 | Luehring ..... 218/138 |
| 4,709,126 | A | | 11/1987 | Miller et al. |
| 5,107,592 | A | | 4/1992 | Downey et al. |
| 5,168,139 | A | | 12/1992 | Bettge et al. |
| 5,191,180 | A | | 3/1993 | Kitamura et al. |
| 5,510,592 | A | | 4/1996 | Gentsch et al. |
| 5,594,224 | A | | 1/1997 | Tanimizu et al. |
| 5,597,992 | A | | 1/1997 | Walker |

(Continued)

FOREIGN PATENT DOCUMENTS

| | | |
|---|---|---|
| EP | 0 782 160 A2 | 7/1997 |
| FR | 2 854 983 A1 | 11/2004 |

(Continued)

OTHER PUBLICATIONS

European Search Report dated May 24, 2012 issued in corresponding EP application No. 12152955.6, 7 pages.

*Primary Examiner* — Truc Nguyen
(74) *Attorney, Agent, or Firm* — Snyder, Clark, Lesch & Chung, LLP

(57) ABSTRACT

An electrical switch includes a tubular housing that includes an interface positioned intermediate the conductor receiving end and the operating end. An operating rod extends through the housing. A fixed contact is electrically coupled to the operating end. A moveable contact is electrically coupled to the interface and the operating rod, wherein the moveable contact is moveable between a first position contacting the fixed contact and a second position separated from the fixed contact. A diaphragm is positioned in the tubular housing between the interface and the operating end and includes a first tubular portion and a second tubular portion. Movement of the operating rod from the first position to the second position causes the second tubular portion to move relative to the first tubular portion, thus deforming the shoulder portion.

20 Claims, 5 Drawing Sheets

(56) References Cited

U.S. PATENT DOCUMENTS

| | | | | |
|---|---|---|---|---|
| 5,667,060 | A | 9/1997 | Luzzi | |
| 5,717,185 | A | 2/1998 | Smith | |
| 5,808,258 | A * | 9/1998 | Luzzi | 218/136 |
| 5,864,942 | A * | 2/1999 | Luzzi | 29/622 |
| 6,310,310 | B1 | 10/2001 | Wristen | |
| 6,417,472 | B1 | 7/2002 | Kusserow et al. | |
| 7,397,012 | B2 | 7/2008 | Stepniak et al. | |
| 7,579,571 | B2 * | 8/2009 | Siebens et al. | 218/120 |
| 7,781,694 | B2 | 8/2010 | Stoving | |

FOREIGN PATENT DOCUMENTS

| | | |
|---|---|---|
| JP | S54-137863 | 10/1979 |
| JP | 2008-171654 | 7/2008 |
| JP | 2009-252475 | 10/2009 |
| MX | 9 606 631 A | 1/1998 |

* cited by examiner

FLEXIBLE SEAL FOR HIGH VOLTAGE SWITCH

CROSS-REFERENCE TO RELATED APPLICATION

This application claims priority under 35. U.S.C. §119, based on U.S. Provisional Patent Application No. 61/437,838 filed Jan. 31, 2011, the disclosure of which is hereby incorporated by reference herein.

BACKGROUND OF THE INVENTION

The present invention relates to the field of electrical switches and more particularly to an electrical switch whose contacts are located within an insulating environmental enclosure, such as a ceramic bottle. One of the contacts may be actuated by a mechanical system outside of the enclosure connected by a shaft extending through an enclosure seal.

In conventional systems, the actuating mechanisms typically form a ground connection in the switch and, unless precautions are taken, current may arc from the switch assembly to the actuating mechanism, causing failure or damage. To address this, conventional high voltage switches, such as overhead reclosers typically utilize a lengthy fiberglass pull rod to connect the actuating mechanism to the switch contact. The insulative fiberglass rod extends through an air filled cavity. Unfortunately, this configuration takes a significant amount of physical space.

DETAILED DESCRIPTION OF THE PREFERRED EMBODIMENTS

The following detailed description refers to the accompanying drawings. The same reference numbers in different drawings may identify the same or similar elements.

Figure 1A:
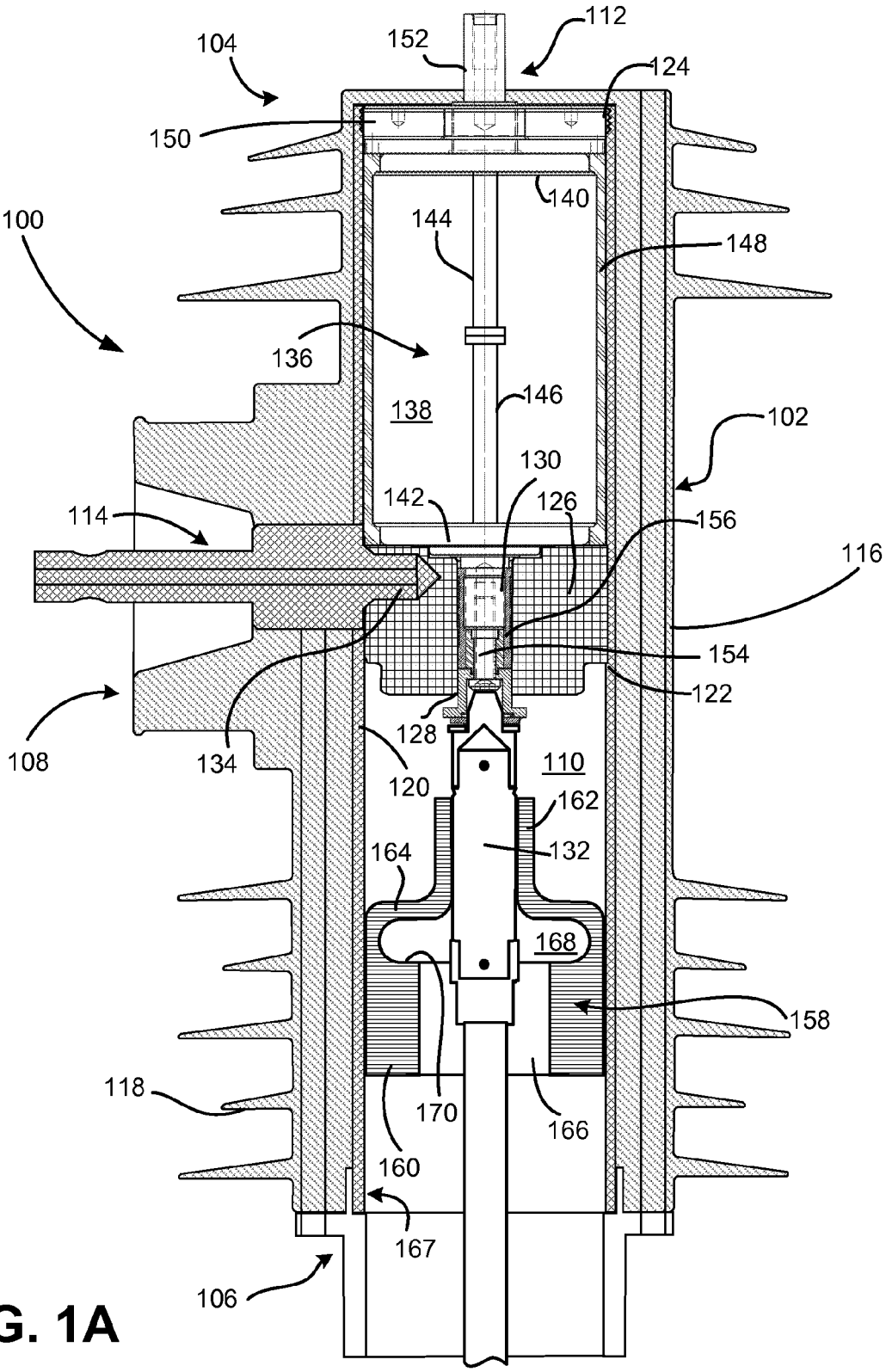
FIGS. 1A and 1B are schematic cross-sectional diagrams illustrating a high voltage switch consistent with implementations described herein.
Figure 1B:
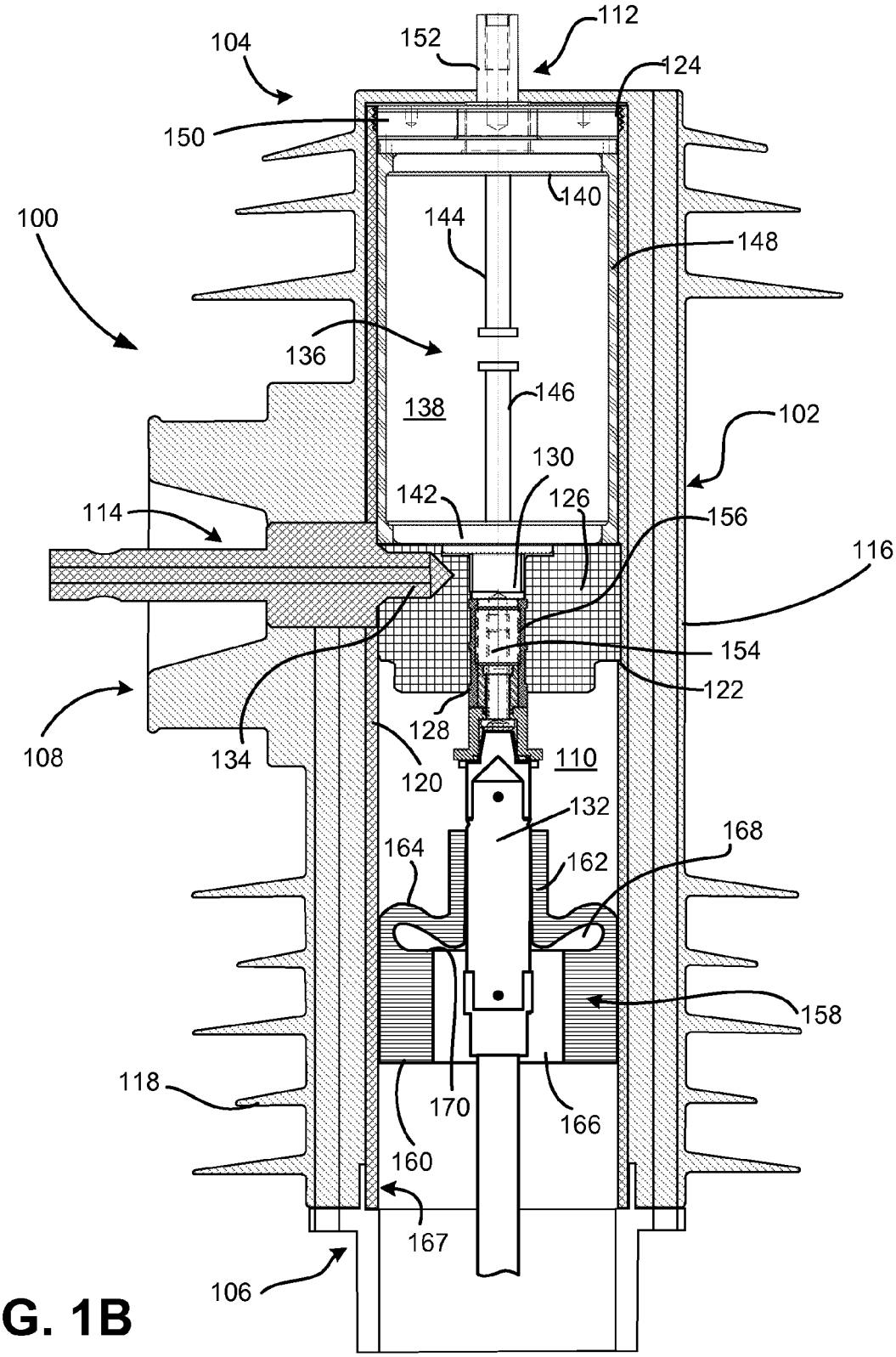

FIGS. 1A and 1B are schematic cross-sectional diagrams illustrating a high voltage switch 100 configured in a manner consistent with implementations described herein. As used in this disclosure with reference to the apparatus (e.g., switch 100), the term "high voltage" refers to equipment configured to operate at a nominal system voltage above 3 kilovolts (kV). Thus, the term "high voltage" refers to equipment suitable for use in electric utility service, such as in systems operating at nominal voltages of about 3 kV to about 38 kV, commonly referred to as "distribution" systems, as well as equipment for use in "transmission" systems, operating at nominal voltages above about 38 kV.

FIG. 1A illustrates switch 100 in an engaged (e.g., "on") configuration and FIG. 1B illustrates switch 100 in a disengaged (e.g., "off") configuration. As shown in FIG. 1A, high voltage switch 100 may include a housing 102, a conductor receiving end 104, an operating end 106, and a bushing interface 108 extending substantially perpendicularly from the housing 102. As briefly described, above switch 100 may be configured to provide selectable connection between conductor receiving end 104 and bushing interface 108.

Housing 102 may define an elongated bore 110 extending axially through housing 102. Conductor receiving end 104 may terminate one end of bore 110 and operating end 106 may terminate an opposite end of bore 110. Bushing interface 108 may project substantially perpendicularly from a portion of housing 102 intermediate conductor receiving end 104 and operating end 106. As described in additional detail below, switch 100 may be configured to provide mechanically moveable contact between a contact assembly 112 associated with conductor receiving end 104 and contact assembly 114 associated with bushing interface 108.

High voltage switch 100 may include an outer shield 116 formed from, for example, a dielectric silicone, elastomer or rubber, which is vulcanized under heat and pressure, such as ethylene-propylene-dienemonomer (EPDM) elastomer. As shown in FIGS. 1A and 1B, in some implementations, outer shield 112 may include a number of radially extending fins 118 for increasing a creep distance on an exterior of housing 102. This is desirable in above-ground or weather-exposed switch installations, such as overhead switches or reclosers.

Within shield 116, switch 100 may include a rigid reinforcing sleeve 120 that extends substantially the entire length of housing 102 and bore 110. Consistent with implementations described herein, reinforcing sleeve 120 may be formed from a dielectric material having high physical strength such as fiber reinforced thermosetting polymers, fiber reinforced thermoplastic polymers, and high strength polymers. Among the materials that can be used are fiberglass reinforced epoxy, polyamides, polyvinyl chloride, and ultra high molecular weight polyethylene.

As shown in FIG. 1A, reinforcing sleeve 120 may be provided with an annular shoulder 122 facing towards conductor receiving end 104. Reinforcing sleeve 120 protrudes slightly beyond the tip of outer shield 112 at conductor receiving end 104 and includes inner threads 124 thereon. As shown, reinforcing sleeve 120 includes an opening aligned with the bore of a bushing interface 108.

Switch 100 further includes an operating end buttress 126 positioned within reinforcing sleeve 120 in a region proximate to bushing interface 108. Operating end buttress 126 is formed from a metallic, electrically conductive material, preferably copper or a copper alloy. In one implementation, operating end buttress has a cylindrical shape for engaging annular shoulder 122 in reinforcing sleeve 120. A bore 128 extends through operating end buttress 126 and is substantially coaxial with the axis of the housing 102 and reinforcing sleeve 120. As described in additional detail below, bore 128 is configured to receive a link 130 connected to an operating rod 132 that extends through operating end 106. Operating end buttress 126 may further include a threaded fitting (not shown) for receiving a correspondingly threaded bolt 134 associated with contact assembly 114. As further discussed below, operating end buttress 126 operates as a terminal for passage of current through switch 100, when the switch is engaged (as shown in FIG. 1A). Bolt 134 maintains electrical continuity between the contact assembly 114 and operating end buttress 126.

As shown in FIG. 1A, a contact assembly 136 is disposed between operating end buttress 126 and the conductor receiving end 104 of switch 100. In some implementations, contact assembly 136 may include a vacuum bottle assembly that includes a tubular ceramic bottle 138 having a fixed end closure 140 adjacent conductor receiving end 104 and an operating end closure 142 disposed at the opposite, operating end of the bottle 138.

A fixed contact 144 may project rearwardly into bottle 138 at fixed end closure 140 and may conductively communicate with contact assembly 112, extending forwardly from bottle 138. In some implementations, contact assembly 112 may be formed integrally with fixed contact 144. Further, although not shown in FIG. 1A or 1B, operating end closure 140 may include a flexible, extensible metallic bellows coupled or otherwise attached to a moveable contact 146. Moveable contact 146 may extend out of bottle 138 and into operating end buttress 126. Vacuum bottle 138 is hermetically sealed, such that bottle 138 and contacts 144/146 are maintained gas-tight throughout the use of switch 100.

In addition, the interior space within bottle 138, surrounding contacts 144/146 has a controlled atmosphere therein. As used herein, the term "controlled atmosphere" means an atmosphere other than air at normal atmospheric pressure. For example, the atmosphere within bottle 138 may be maintained at a subatmospheric pressure. The composition of the atmosphere may also differ from normal air. For example, bottle 138 may include arc-suppressing gases such as $SF_6$ (sulphur hexafluoride).

As shown in FIGS. 1A and 1B, an exterior diameter of vacuum bottle 138 may be sized slightly less than an interior diameter of reinforcing sleeve 120, so that there is an annular space between the outside of the bottle and the inside of the reinforcing element. Upon installation of bottle 138 within reinforcing sleeve 120 (e.g., abutting a rearward end of bottle 138 against a forward shoulder of operating end buttress 126), the annular space is completely filled with a dielectric filler material 148, so as to provide a substantially void-free interface between the outside of the bottle and the inside of the reinforcing element.

Filler 148 may be formed of a dielectric material different from the dielectric material of housing 102. For example, dielectric filler 148 may be formed from a material that can be placed and brought to its final form without application of extreme temperatures or pressures. Exemplary dielectric fillers may include greases, (e.g., petroleum-based and silicone-based greases), gels (e.g., silicone gels), and curable elastomers of the type commonly referred to as room-temperature vulcanizing or "RTV" elastomers.

A fixed end buttress 150 may be provided at conductor receiving end 104 adjacent a fixed end closure 140 of bottle 138. For example, fixed end buttress 150 may engage threads 124 of reinforcing sleeve 120 and further engage fixed end closure 140. As shown, fixed end buttress 150 may include a central bore for receiving a stub contact 152 in contact with fixed end closure 140. During assembly, fixed end buttress 150 operates to force bottle 138 towards operating end buttress 126. Thus, bottle 138 is maintained under compression. Although not shown in the Figures, stub contact 152 may be configured to receive a terminal thereon. The terminal may be configured to further couple to a contact assembly of bushing or other device installed on conductor receiving end 104.

Returning to operating end buttress 126, link 130 may be conductively coupled to moveable contact 146 and may be slidably positioned within bore 128. Link 130 may be further coupled to operating rod 132 extending through operating end 106, such that movement of operating rod 132 in an axial direction within housing 102 may cause a corresponding axial movement of moveable contact 146, into and out of contact with fixed contact 144.

As shown, in one implementation, link 130 may be coupled to the end of moveable contact 146 via a bolt 154, although any suitable attachment mechanism may be used. Link 130 may include an annular contact 156 configured to engage an inside surface of bore 128, thereby establishing a slidable electrical connection between operating end buttress 126 and link 130. Additionally, link 130 may include a recess or cavity for receiving a forward end of operating rod 132. Operating rod 132 may be secured to link 130 via any suitable mechanism, such as mating threads, a pin or pins, rivets, groove/snap ring, etc. Operating rod 132 may be formed of an insulating material, such as fiberglass, epoxy-reinforced fiberglass, etc. In addition, as shown in FIGS. 1A and 1B, operating rod 132 may be formed of more than one components, such as a forward rod and a rearward rod.

In some implementations, a coil compression spring (not shown) may be disposed around a forward portion of operating rod 132 between the remainder of operating rod 132 and the end of link 130, so that motion of operating rod 132 in the closing direction (e.g., toward conductor receiving end 104) will be transmitted to link 130 and hence to moveable contact 146.

Operating rod 132 may be further coupled to ground and may further be affixed or secured to a suitable driving or actuating mechanism (not shown). For example, operating rod 132 may be attached to a manual actuation device (e.g., a handle or level), a solenoid-based actuating device, an automatic recloser device, etc. Actuation of such an actuating device may cause operating rod 132 to move forward or rearward within housing 102, thereby causing moveable contact 146 to move into and out of contact with fixed contact 144 (via link 130).

Consistent with implementations described herein, switch 100 further includes a flexible diaphragm 158 for providing voltage separation between operating end buttress 126/link 130, and operating end 106. Diaphragm 158 may be formed of any suitable insulative, resilient material, such as EPDM, silicone, TPE (thermoplastic elastomer), etc. As shown, diaphragm 158 includes a shoulder-like configuration with a rearward tubular portion 160 and a forward tubular portion 162 having an outside diameter smaller than the outside diameter of rearward tubular portion 160. Diaphragm 158 also includes a shoulder portion 164 between rearward tubular portion 160 and forward tubular portion 162. Diaphragm 158 includes an axial bore 166 formed through rearward tubular portion 160 and a forward tubular portion 162 for receiving operating rod 132 therethrough.

In an exemplary implementation, rearward tubular portion 160 may have an outside diameter of approximately 2.75 inches, and an inside diameter of approximately 1.50 inches, thus resulting in a thickness of rearward tubular portion 160 of approximately 0.625 inches. It should be understood that these dimensions are exemplary and different dimensions may be used based on the requirements of the high voltage switch in which diaphragm is used.

In one implementation, the outside diameter of rearward tubular portion 160 may be sized slightly larger than an inside diameter of reinforcing sleeve 120, such that diaphragm 158 is secured within bore 110 via a interference/friction relationship between the outside surface of rearward tubular portion 160 and the inside surface 167 of reinforcing sleeve 120. For example, diaphragm 158 may be forceably inserted into bore 110 of reinforcing sleeve 120. Securing diaphragm 158 within bore 110 via an interference fit, rather than molding or bonding diaphragm 158 to reinforcing sleeve 120 allows diaphragm 158 to be inserted following assembly of switch 100 and further allows for replacement of diaphragm 158 in the event of damage or failure.

As shown in FIG. 1A, an inside diameter of bore 166 in forward tubular portion 162 may be sized to frictionally engage an outside surface of operating rod 132. For example, the inside diameter of forward tubular portion 162 may be slightly smaller than the outside diameter of operating rod 132. Upon insertion of diaphragm 158 into switch housing 102, forward tubular portion 162 may be slid to a desired position on operating rod 132.

Consistent with implementations described herein, diaphragm 158 may be configured to enable forward tubular portion 162 to deflect a predetermined distance toward rearward tubular portion 160 during actuation of operating rod 132. For example, as shown in FIG. 1A, diaphragm 158 may include an inner annular groove 168 in a region proximal to shoulder portion 164. Annular groove 168 may reduce a thickness of diaphragm 158 in shoulder portion 164 sufficiently to enable deflection forward tubular portion 162. Furthermore, annular groove 168 may define an inner shoulder 170 within rearward tubular portion 160. Inner shoulder 170 establishes a maximum deflection distance or travel distance of forward tubular portion 162 relative to rearward tubular portion 160. In one implementation, groove 168 may be approximately 0.5 inches in width. Accordingly, the maximum deflection distance or travel distance for operating rod 132 is likewise approximately 0.5 inches.

As shown in FIG. 1B, upon rearward movement of operating rod 132, forward tubular portion 162 may travel toward rearward tubular portion 160, and shoulder portion 164 may be deflected, such that an interior of shoulder portion 164 is pulled rearwardly along with forward tubular portion 162. The length of travel is limited by inner shoulder 170, so that when shoulder portion 164 deflects fully, or by a maximum amount, an inside surface of shoulder portion 164 may contact inner shoulder 170, thereby limiting further movement. The material selected for diaphragm 158 may further enable efficient resilient deflection of forward tubular portion 162.

Consistent with embodiments described herein, diaphragm 158 should be thick enough to provide full voltage withstand capability. That is, the thickness of shoulder portion 164 of diaphragm 158 is selected so that the diaphragm can withstand the maximum voltage to be imposed between the current-carrying elements of the switch (e.g., operating buttress 126, moveable contact 144, etc.) and ground during service or during fault conditions, thereby preventing arcing. For example, in a switch designed to operate at a nominal 25 kV phase-to-phase, diaphragm 158 should be capable of withstanding at least about 14.4 kV continuously. In one exemplary embodiment, a thickness of shoulder portion 164 is approximately 0.20 inches.

Figure 2A:
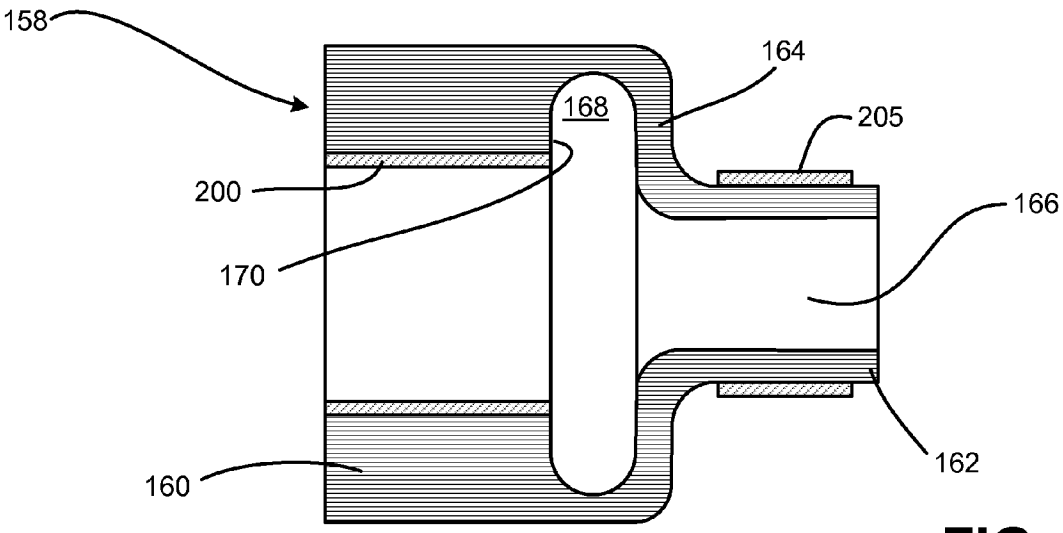
FIG. 2A is a cross-sectional diagram illustrating the diaphragm of FIG. 1 in an alternative embodiment.
Figure 2B:
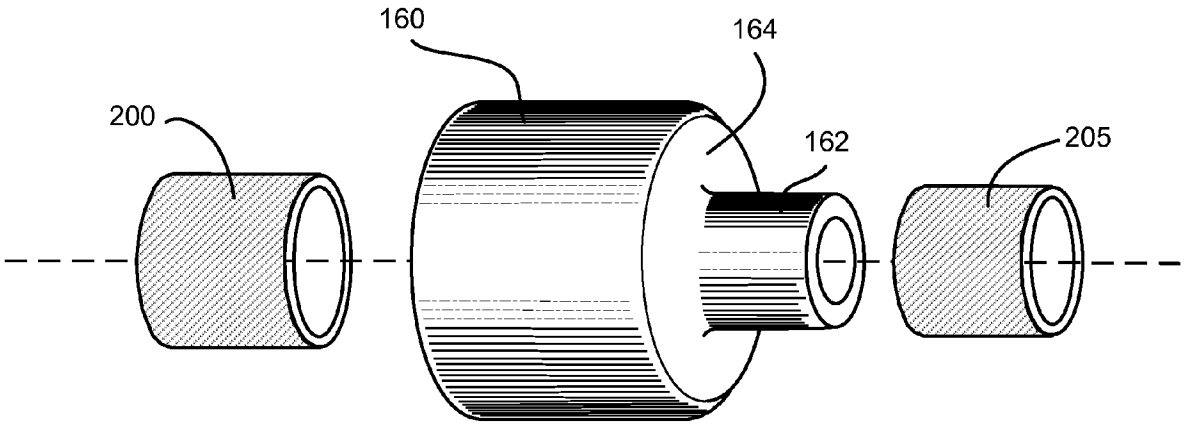
FIG. 2B is an exploded isometric diagram illustrating the diaphragm of FIG. 2A.

FIGS. 2A and 2B are cross-sectional and exploded isometric diagrams, respectively, illustrating diaphragm 158 consistent with an alternative embodiment. As shown, in some implementations, collars 200 and 205 may be used to reinforce the sidewalls of rearward tubular portion 160 and forward tubular portion 162, respectively. For example, collar 200 may have an outside diameter substantially similar to the inside diameter of rearward tubular portion 160. Collar 200 may provide structural rigidity to rearward tubular portion 160, thereby providing an increased frictional interface force with the inside of reinforcing sleeve 120 (not shown in FIG. 2A).

Collar 205 may have an inside diameter substantially similar to the outside diameter of forward tubular portion 162. Collar 205 may be positioned on the outside of forward tubular portion 162 and may provide structural rigidity to forward tubular portion 162, thereby providing an increased frictional interface force with the outside of operating rod 132 (not shown in FIG. 2A).

In some implementations, collars 200/205 may be bonded to diaphragm 158 during molding of diaphragm 158. In other implementations, collars 200/205 may be inserted or installed following molding of diaphragm 158. Collars 200/205 may be formed of any rigid or semi-rigid, insulative material, such as plastic, etc.

Figure 3B:
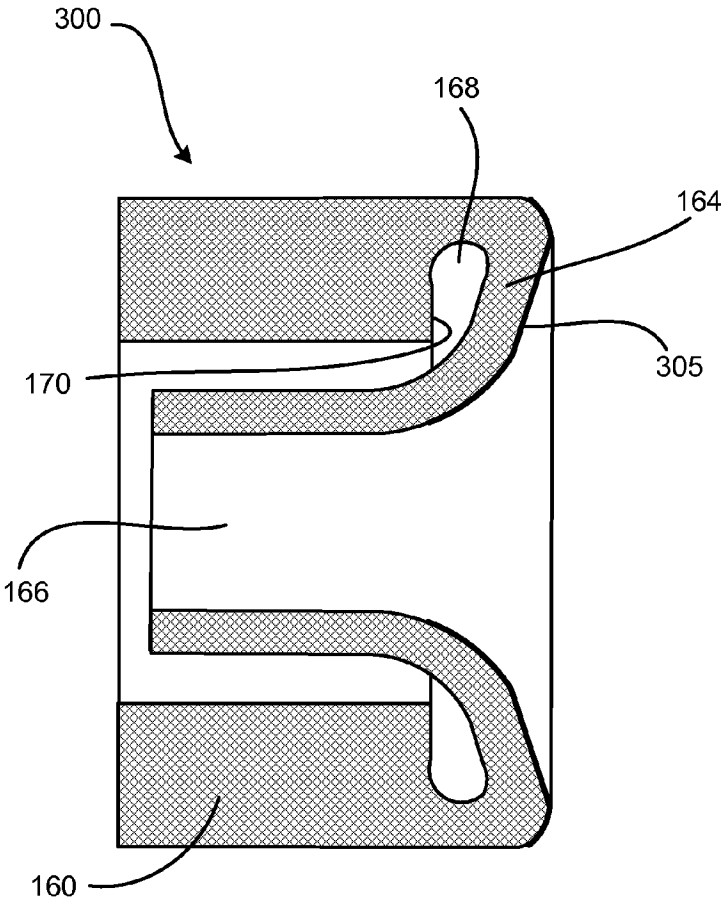
FIGS. 3A and 3B are cross-sectional views of another alternative diaphragm.
Figure 3A:
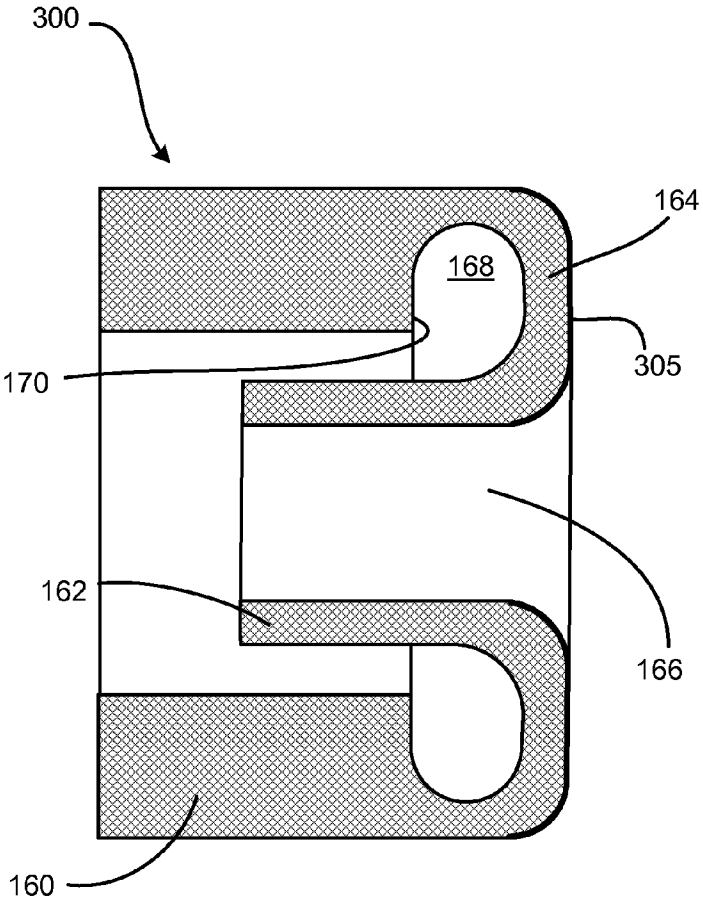
Figure 4:
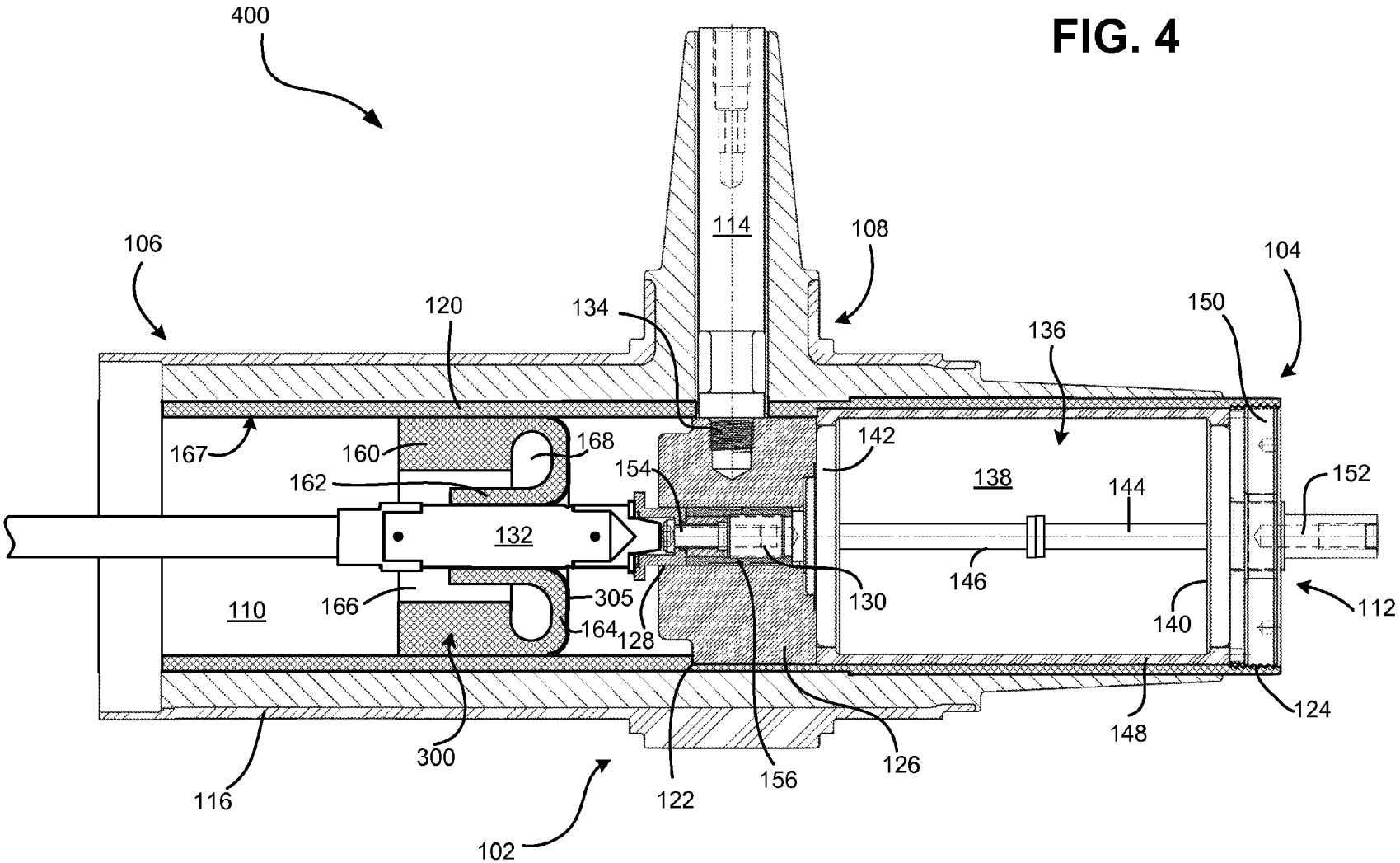
FIG. 4 is a cross-sectional diagram illustrating a high voltage switch including the diaphragm of FIG. 3A.

FIGS. 3A and 3B are cross-sectional diagrams illustrating a diaphragm 300 in extended and contracted positions, respectively, consistent with another alternative embodiment. FIG. 4 is a cross-sectional diagram of a high voltage switch assembly 400 including diaphragm 300. As shown, diaphragm 300 includes in inverted configuration, in which forward tubular portion 162 is turned into rearward tubular portion 160. The effect of this configuration is to shorten the overall length of diaphragm 300 relative to diaphragm 158, thereby enabling use in switchgear components having less available axial space, such as underground or transformer-based switchgear. In some implementations, a shoulder portion 164 may be coated or painted with a thin conductive layer 305. Conductive layer 305 provides continuity of conductive surfaces within switch housing 102, thereby effectively forming a Faraday cage for protecting switch 100. In other implementations, conductive layer 305 may include a conductive annular disc.

Similar to diaphragm 158, a thickness of shoulder portion 164 in diaphragm 300 is sufficient to provide full voltage withstand capability. Further, inner shoulder 170 establishes the maximum deflection distance or travel distance of forward tubular portion 162 relative to rearward tubular portion 160. As shown in FIG. 3B, upon rearward movement of operating rod 132 (not shown in FIG. 3B), forward tubular portion 162 may travel toward rearward tubular portion 160, and shoulder portion 164 may be deflected, such that an interior of shoulder portion 164 is pulled rearwardly along with forward tubular portion 162. The length of travel is limited by inner shoulder portion 170, so that when shoulder portion 164 deflects fully, an inside surface of shoulder portion 164 may contact inner shoulder 170 (not shown), thereby limiting further movement.

By providing a collapsible or deformable voltage withstanding diaphragm positioned between ground and voltage conducting elements in a high voltage switch, embodiments described herein are able to provide an effect switch mechanisms with reduced size requirements. For example, in some instances, incorporation of a diaphragm, such as diaphragm 158 or 300, can reduce an overall length of a high voltage switch by approximately 66%. Moreover, friction/interference nature of diaphragm installation provides ease of installation and replacement.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein may also be used in conjunction with other devices, such as high or medium voltage switchgear equipment, including 15 kV, 25 kV, or 35 kV equipment.

For example, various features have been mainly described above with respect to high voltage switches in both overhead and underground switchgear environments. In other implementations, other medium/high voltage power components may be configured to include the deformable/collapsible diaphragm configurations described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical switch, comprising:

a tubular housing having a conductor receiving end and an operating end opposite the conductor receiving end, wherein the tubular housing includes an interface positioned intermediate the conductor receiving end and the operating end;

an operating rod extending through the operating end toward the conductor receiving end;

a fixed contact electrically coupled to the operating end;

a moveable contact electrically coupled to the interface and the operating rod, wherein the moveable contact is moveable between a first position contacting the fixed contact and a second position separated from the fixed contact; and a diaphragm positioned in the tubular housing between the interface and the operating end to prevent voltage from the interface from arcing to the operating end, wherein the diaphragm includes a bore therethrough for receiving the operating rod, wherein the diaphragm includes a first tubular portion and a second tubular portion having an outside diameter smaller than an outside diameter of the first tubular portion, and a shoulder portion between the first tubular portion and the second tubular portion, wherein the first tubular portion is frictionally engaged with an inside of the tubular housing and the second tubular portion is frictionally engaged with the operating rod, and wherein movement of the operating rod from the first position to the second position causes the second tubular portion to move relative to the first tubular portion, the movement deforming the shoulder portion.

2. The electrical switch of claim 1, wherein the first tubular portion of the diaphragm comprises an inner annular groove adjacent the shoulder portion.

3. The electrical switch of claim 2, wherein a width of the inner annular groove defines a travel distance of the second tubular portion relative to the first tubular portion.

4. The electrical switch of claim 1, wherein the diaphragm comprises an insulative, resilient material.

5. The electrical switch of claim 4, wherein the diaphragm comprises an ethylene-propylene-dienemonomer (EPDM) elastomer, silicone, or a thermoplastic elastomer.

6. The electrical switch of claim 1, wherein the housing comprises:

an insulative outer shield; and a reinforcing sleeve, wherein an outer surface of the first tubular portion is frictionally engaged with an inside surface of the reinforcing sleeve.

7. The electrical switch of claim 6, wherein the reinforcing sleeve comprises fiberglass.

8. The electrical switch of claim 1, further comprising:

a reinforcing collar positioned on at least one of the first tubular portion and the second tubular portion.

9. The electrical switch of claim 8, wherein the reinforcing collar is positioned on an inside surface of the first tubular portion.

10. The electrical switch of claim 8, wherein the reinforcing collar is positioned on an outside surface of the second tubular portion.

11. The electrical switch of claim 8, wherein the reinforcing collar comprises a rigid or semi-rigid plastic.

12. The electrical switch of claim 1, wherein second tubular portion projects away from the first tubular portion.

13. The electrical switch of claim 1, wherein second tubular portion projects within the bore in the first tubular portion.

14. The electrical switch of claim 13, further comprising a conductive coating on the shoulder portion.

15. The electrical switch of claim 1, further comprising a vacuum bottle for maintaining the moveable contact and the fixed contact in a pressurized, isolated environment.

16. The electrical switch of claim 1, further comprising an operating buttress electrically coupled to the interface, wherein the operating buttress includes a bore therethrough for providing slidable, electrical contact with the moveable contact.

17. An high voltage electrical switch, comprising:

a housing having a fixed end, an intermediate interface, and an operating end opposite the fixed end, wherein the housing includes a first bore extending axially therethrough;

an operating buttress mounted within the bore proximate the intermediate interface, wherein the operating buttress is electrically coupled to the intermediate interface and includes a second bore extending axially therethrough;

a fixed contact electrically coupled to the fixed end;

a moveable contact electrically coupled to the operating buttress via the second bore, wherein the moveable contact is moveable between a first position contacting the fixed contact and a second position separated from the fixed contact;

an insulative operating rod coupled to the moveable contact, wherein axial movement of the operating rod causes corresponding movement of the moveable contact between the first position and the second position; and a diaphragm sealingly positioned in the housing between the operating buttress and the operating end to prevent voltage from the interface from arcing to the operating end, wherein the diaphragm includes a bore therethrough for sealingly receiving the operating rod, wherein the diaphragm includes a first tubular portion and a second tubular portion having an outside diameter smaller than an outside diameter of the first tubular portion to create a shoulder portion between the first tubular portion and the second tubular portion, and wherein the first tubular portion is frictionally engaged with an inside of the housing and the second tubular portion is frictionally engaged with the operating rod.

18. The high voltage electrical switch of claim 17, wherein the first tubular portion of the diaphragm comprises an inner annular groove adjacent the shoulder portion to define a travel distance of the second tubular portion relative to the first tubular portion.

19. The high voltage electrical switch of claim 17, further comprising a reinforcing collar positioned on at least one of the first tubular portion and the second tubular portion.

20. The high voltage electrical switch of claim 17, wherein second tubular portion projects within the bore in the first tubular portion.

* * * * *